US009868304B2

(12) United States Patent
Tomomatsu

(10) Patent No.: US 9,868,304 B2
(45) Date of Patent: Jan. 16, 2018

(54) PRINTER

(71) Applicant: Brother Kogyo Kabushiki Kaisha, Nagoya-shi, Aichi-ken (JP)

(72) Inventor: Yoshitsugu Tomomatsu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/429,318

(22) Filed: Feb. 10, 2017

(65) Prior Publication Data

US 2017/0232766 A1 Aug. 17, 2017

(30) Foreign Application Priority Data

Feb. 12, 2016 (JP) ..... 2016-024344

(51) Int. Cl.
*B41J 2/32* (2006.01)
*B41J 13/00* (2006.01)
*B65H 23/34* (2006.01)

(52) U.S. Cl.
CPC ..... *B41J 13/0009* (2013.01); *B41J 2/32* (2013.01); *B65H 23/34* (2013.01)

(58) Field of Classification Search
CPC ..... B41J 2/32; B41J 11/0005; B41J 11/0045; B41J 13/0009; B41J 13/0018; B41J 13/0027; B41J 13/103; B41J 15/042; B65H 23/34; B65H 2220/01; B65H 2301/121
See application file for complete search history.

(56) References Cited

U.S. PATENT DOCUMENTS 5,533,821 A * 7/1996 Awai ..... B41J 15/042 347/219
6,987,523 B2 * 1/2006 Fujiwara ..... B41J 11/0005 347/218
8,339,432 B2 * 12/2012 Kawashima ..... B41J 2/32 347/218
8,608,157 B2 * 12/2013 Fujikura ..... B65H 3/0883 271/106

FOREIGN PATENT DOCUMENTS

JP H2-057865 U 4/1990

* cited by examiner

*Primary Examiner* — Anh T. N. Vo
(74) *Attorney, Agent, or Firm* — Banner & Witcoff, Ltd.

(57) ABSTRACT

A printer, comprising: a printing part; a conveying mechanism to send out a print medium from a medium roll around which the print medium is wound, the conveying mechanism comprising a correcting mechanism to correct curl of the print medium in a winding direction by curving the print medium in a reverse direction of the winding direction; and a controller configured to: store a finish time of the printing; obtain a start time when next printing is started; determine whether an elapsed time elapsed from the finish time to the start time is longer than a particular time; when the elapsed time is longer than the particular time, cause the conveying mechanism to convey the print medium by a particular length which is longer than a length between the correcting mechanism and the printing part; and cause the printing part to perform the printing.

6 Claims, 9 Drawing Sheets

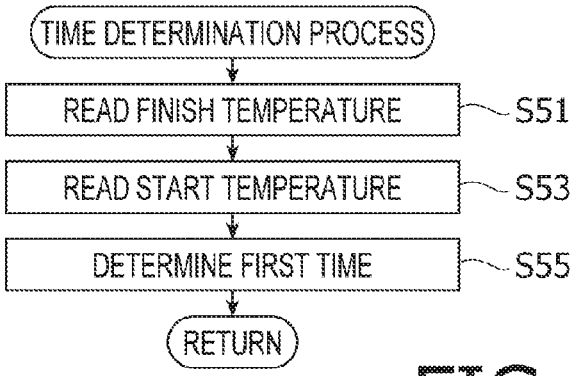
FIG. 10
| FINISH TEMPERATURE | START TEMPERATURE | FIRST TIME |
|---|---|---|
| LOW | LOW | 24 HOURS×7 |
| | MIDDLE | |
| | HIGH | |
| MIDDLE | LOW | |
| | MIDDLE | 24 HOURS×3 |
| | HIGH | |
| HIGH | LOW | |
| | MIDDLE | |
| | HIGH | |
FIG. 11
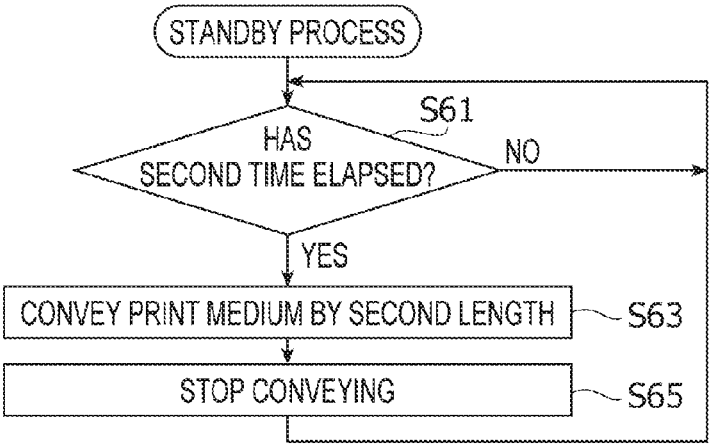
FIG. 12

PRINTER

CROSS-REFERENCE TO RELATED APPLICATION

This application claims priority under 35 U.S.C. §119 from Japanese Patent Application No. 2016-024344, filed on Feb. 12, 2016. The entire subject matter of the application is incorporated herein by reference.

BACKGROUND

Technical Field

Aspects of the present disclosures relate to a printer.

Related Art

Technique concerning a mechanism (a so-called anti-curl mechanism) for correcting curl of rolled paper provided in a printer performing printing on the rolled paper has been proposed. For example, in a rolled paper feeding mechanism, a curl correcting lever of a curl correcting mechanism curves the rolled paper in a reverse direction of a winding direction of the rolled paper, and thereby removes the curl in the winding direction.

SUMMARY

However, in the above described configuration of the rolled paper feeding mechanism, the rolled paper is in a state of being curved in the reverse direction of the winding direction by the curl correcting lever regardless of whether the rolled paper is in a feeding state. Therefore, when a time elapses in a state where the rolled paper is not fed, a curved mark in the reverse direction may be caused on the rolled paper by the curl correcting lever. That is, when the above described technique is used in a printer, a problem arises that the printing is performed on a portion of the rolled paper where the curved mark in the reverse direction of the winding direction is caused.

Aspects of the disclosures provide a printer capable of preventing the printing from being performed on rolled paper having curl.

According to an aspect of the disclosures, there is provided a printer, comprising: a printing part configured to perform printing on a print medium; and a conveying mechanism configured to send out the print medium from a medium roll around which the print medium is wound and to convey the print medium via the printing part. The conveying mechanism comprises a correcting mechanism configured to correct curl of the print medium caused in a winding direction of the print medium by curving the print medium in a reverse direction of the winding direction. The printer further comprises a controller configured to: store a finish time of the printing by the printing part in a storage device; obtain a start time when next printing is started by the printing part after last printing has been finished; determine whether an elapsed time elapsed from the finish time stored in the storage device to the obtained start time is longer than a particular time; when it is determined that the elapsed time is longer than the particular time, cause the conveying mechanism to convey the print medium by a particular length which is longer than a length, in a conveying direction along a conveying path of the print medium, between the correcting mechanism and the printing part; and cause the printing part to perform the printing on the print medium after the print medium has been conveyed by the particular length.

BRIEF DESCRIPTION OF THE ACCOMPANYING DRAWINGS

Figure 5:
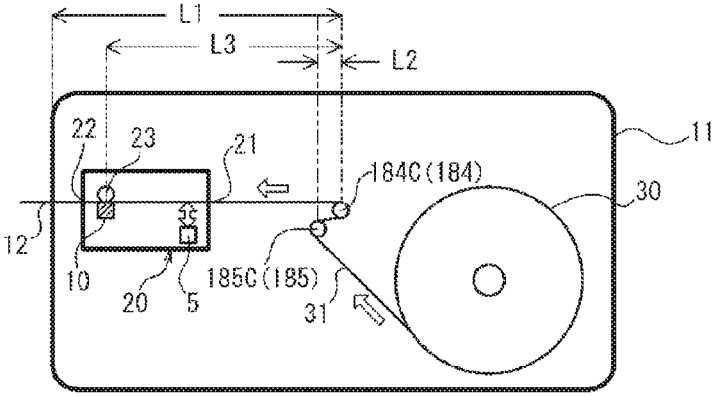

FIG. 5 schematically illustrates a conveying path and first to third lengths L1 to L3 of a print medium in accordance with the illustrative embodiment.

Figure 6:
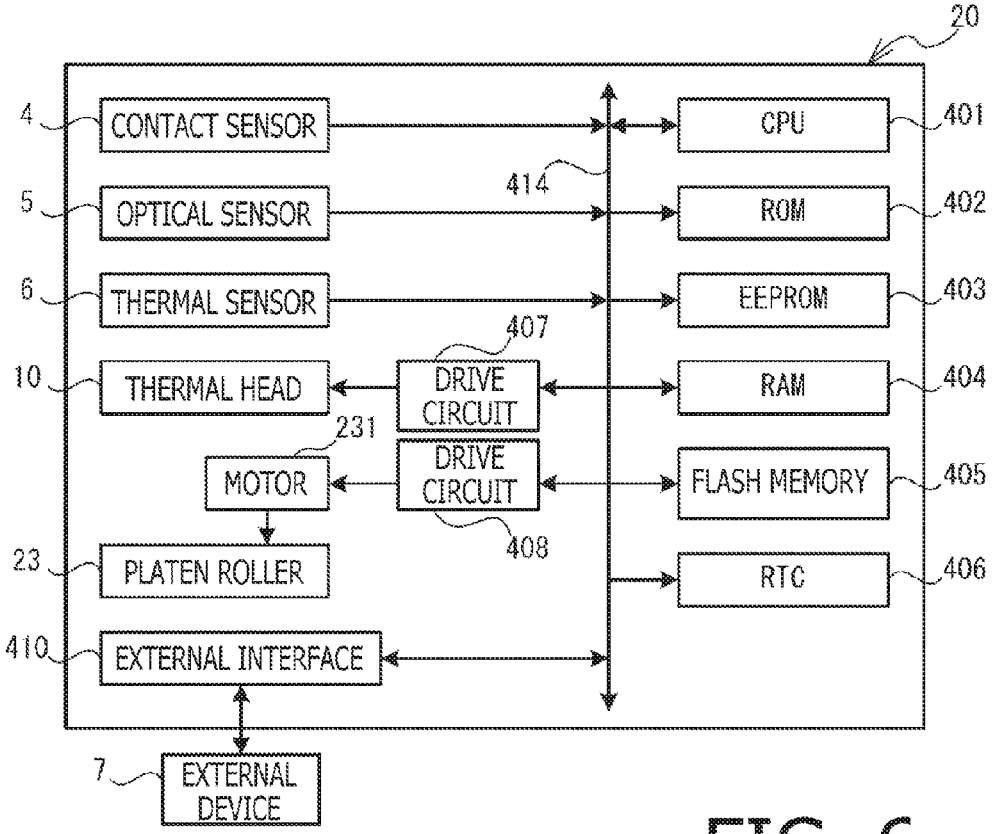

FIG. 6 is a block diagram illustrating an electric configuration of the printer in accordance with the illustrative embodiment.

Figure 7:
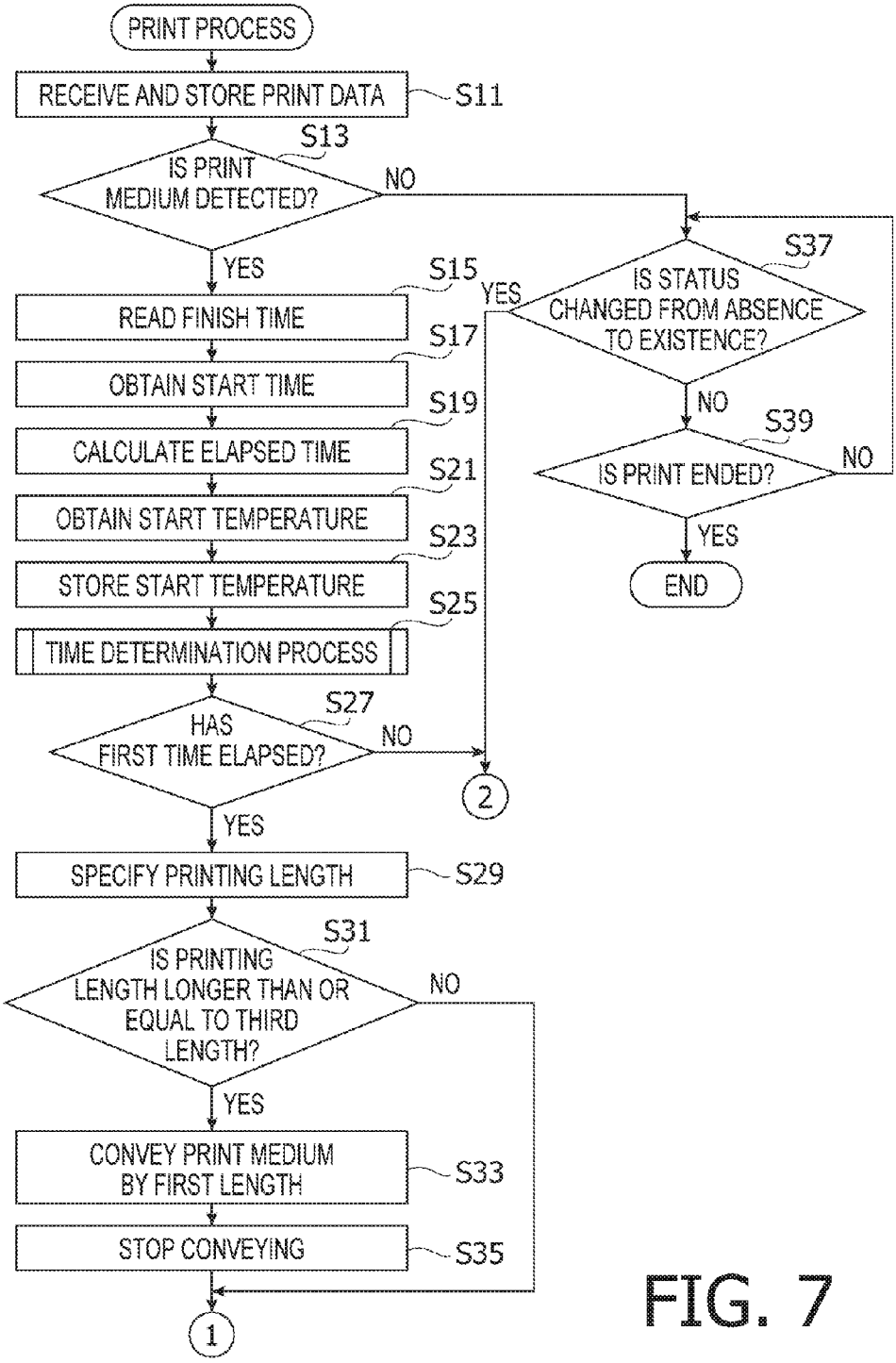

FIG. 7 is a flowchart illustrating a print process in accordance with the illustrative embodiment.

Figure 8:
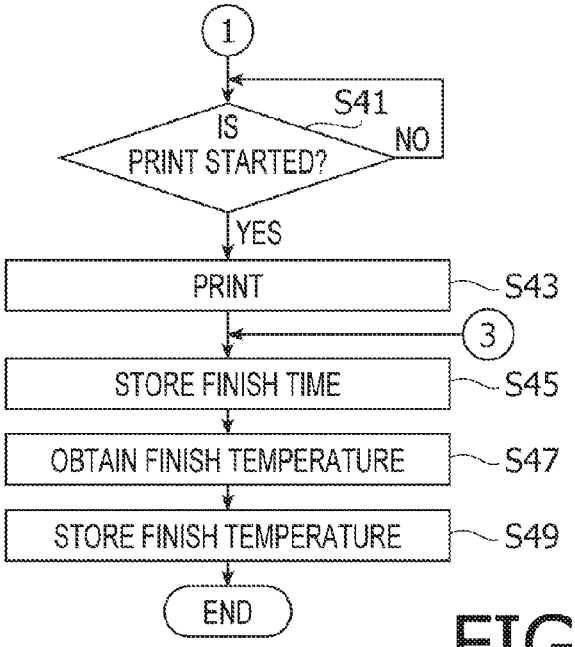

FIG. 8 is a flowchart of the print process continued from FIG. 7.

Figure 9:
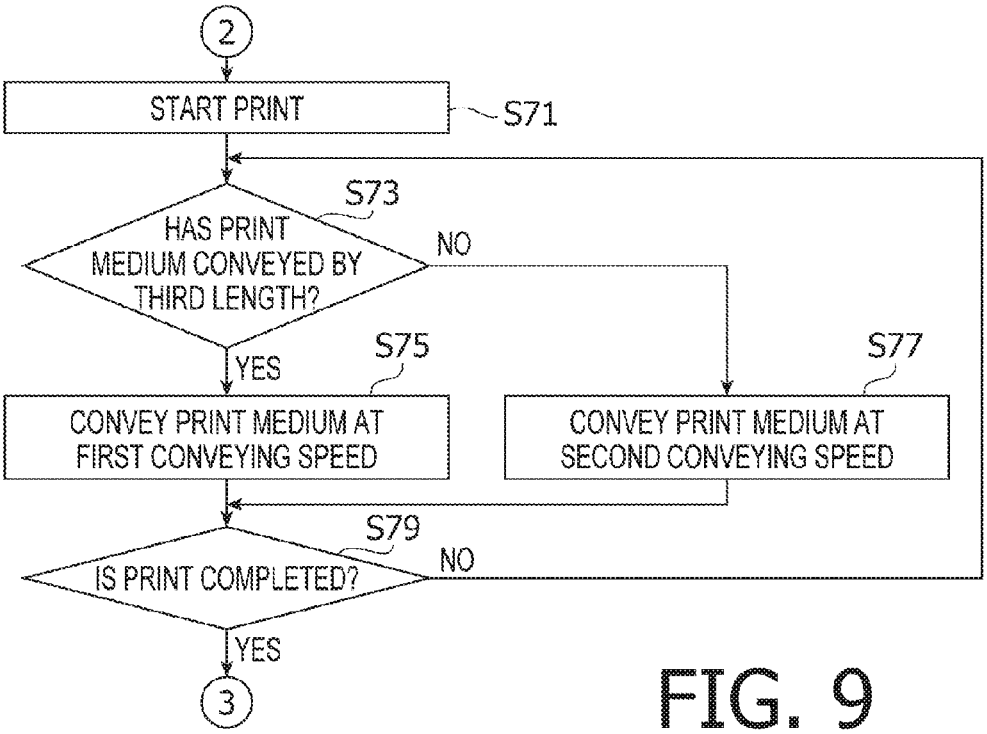

FIG. 9 is a flowchart of the print process continued from FIG. 7.

FIG. 10 is a flowchart illustrating a time determination process in accordance with the illustrative embodiment.

FIG. 11 schematically illustrates a reference table in accordance with the illustrative embodiment.

FIG. 12 is a flowchart illustrating a standby process in accordance with the illustrative embodiment.

Figure 13:
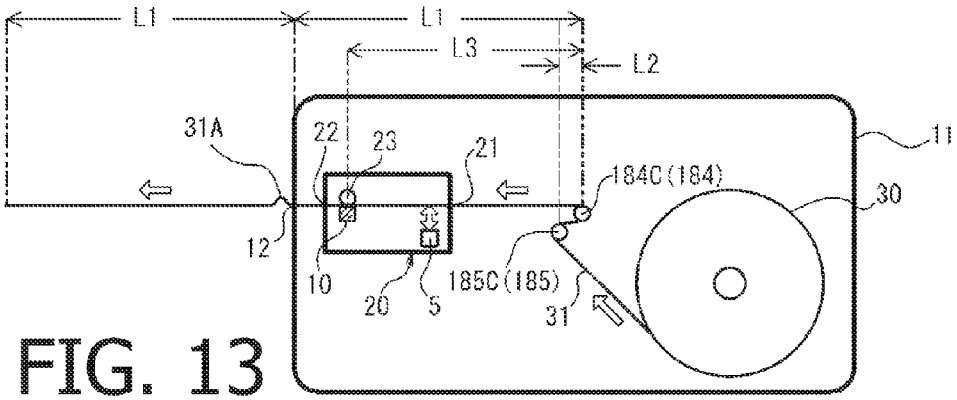

FIG. 13 schematically illustrates a situation where the print medium is conveyed by the first length L1 in accordance with the illustrative embodiment.

Figure 14:
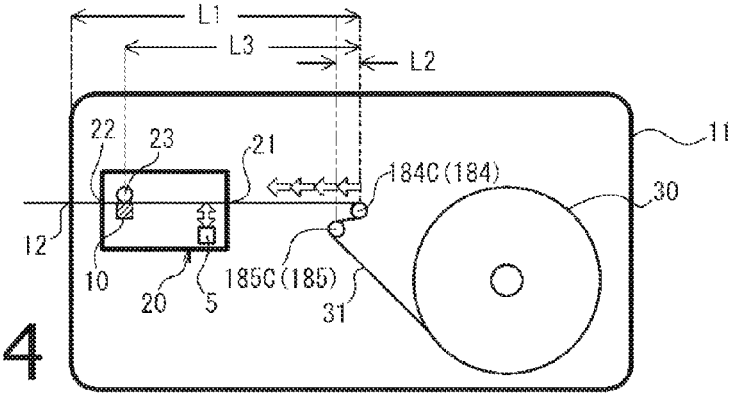

FIG. 14 schematically illustrates a situation where the print medium is periodically conveyed by the second length L2 in accordance with the illustrative embodiment.

Figure 15:
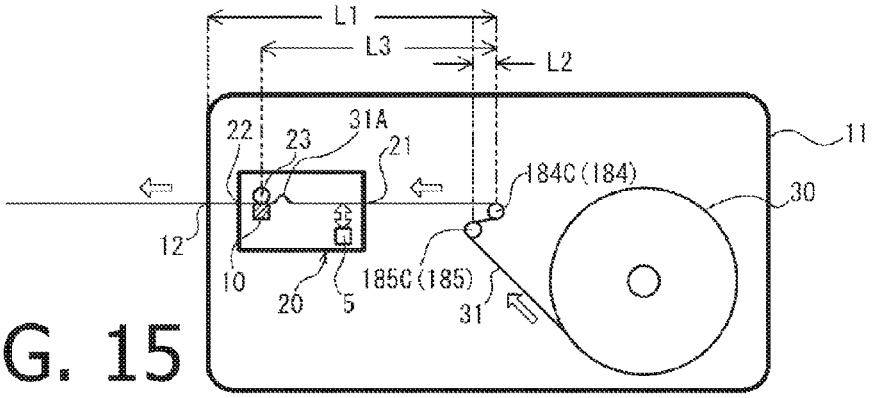

FIG. 15 schematically illustrates a situation where printing is performed on the print medium without being conveyed by the first length L1 in accordance with the illustrative embodiment.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereafter, a printer 20 according to an illustrative embodiment is described with reference to the accompanying drawings. The printer 20 is used in a state where the printer 20 is housed in a printer housing box (hereafter, simply referred to as a "box") shown in FIGS. 1 and 2. Hereafter, a lower left side, an upper right side, an upper left side, a lower right side, an upper side and a lower side in FIG. 1 are respectively referred to as a front side, a rear side, a left side, a right side, an upper side and a lower side of the box.

<Box 11>

Figure 1:
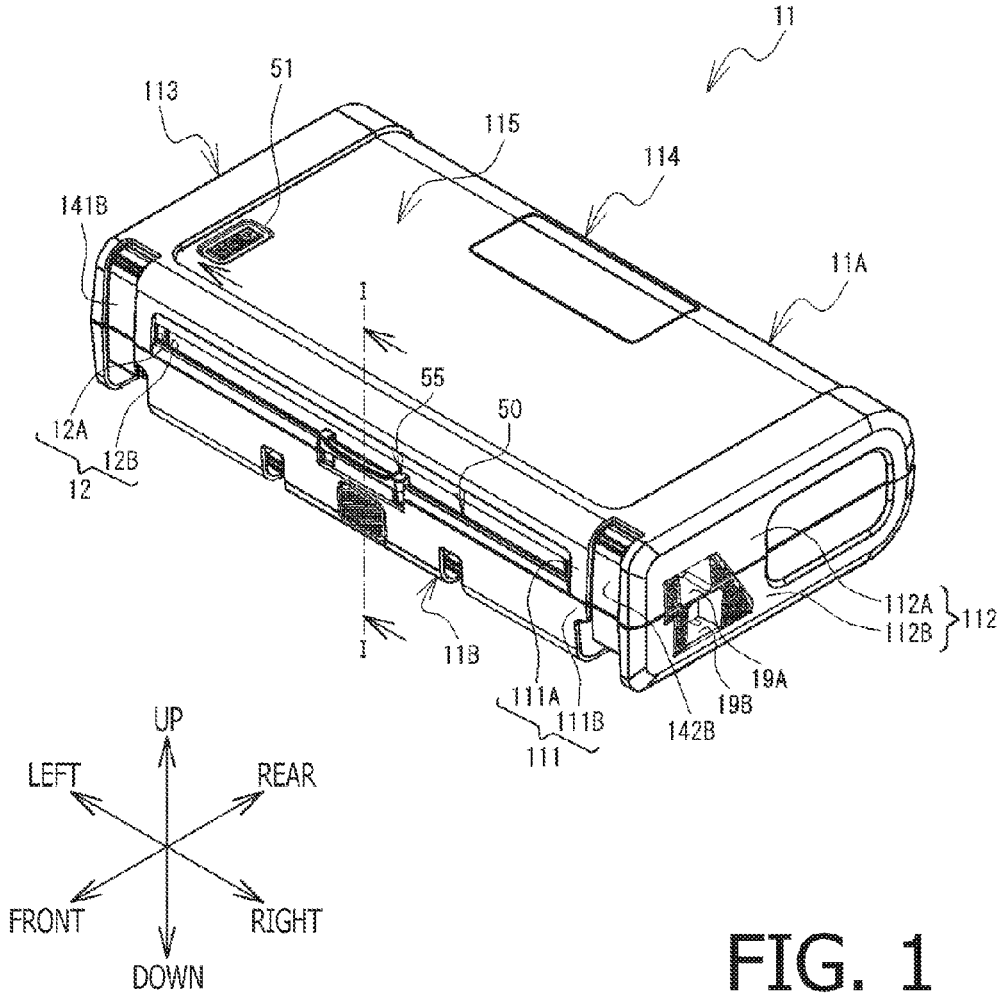
FIG. 1 is a perspective view of a box in a closed state in accordance with the illustrative embodiment.

As shown in FIG. 1, the box 11 is formed in a long box shape elongated in a left and right direction. The box 11 has an upper box 11A and a lower box 11B. The upper box 11A and the lower box 11B respectively correspond to an upper half part and a lower half part of the box 11. The box 11 has a front outer wall 111, a right outer wall 112, a left outer wall 113, a rear outer wall 114, an upper outer wall 115 and a lower outer wall 116 (see FIG. 4). A front outer wall 111A, a right outer wall 112A, a left outer wall 113A (see FIG. 2) and a rear outer wall 114A (see FIG. 2) of the upper box 11A respectively correspond to upper half parts of the front outer wall 111, the right outer wall 112, the left outer wall 113 and the rear outer wall 114 of the box 11. A front outer wall 111B, a right outer wall 112B, a left outer wall 113B (see FIG. 2) and a rear outer wall 114B (see FIG. 2) of the upper box 11A respectively correspond to lower half parts of the front outer wall 111, the right outer wall 112, the left outer wall 113 and the rear outer wall 114 of the box 11.

Figure 2:
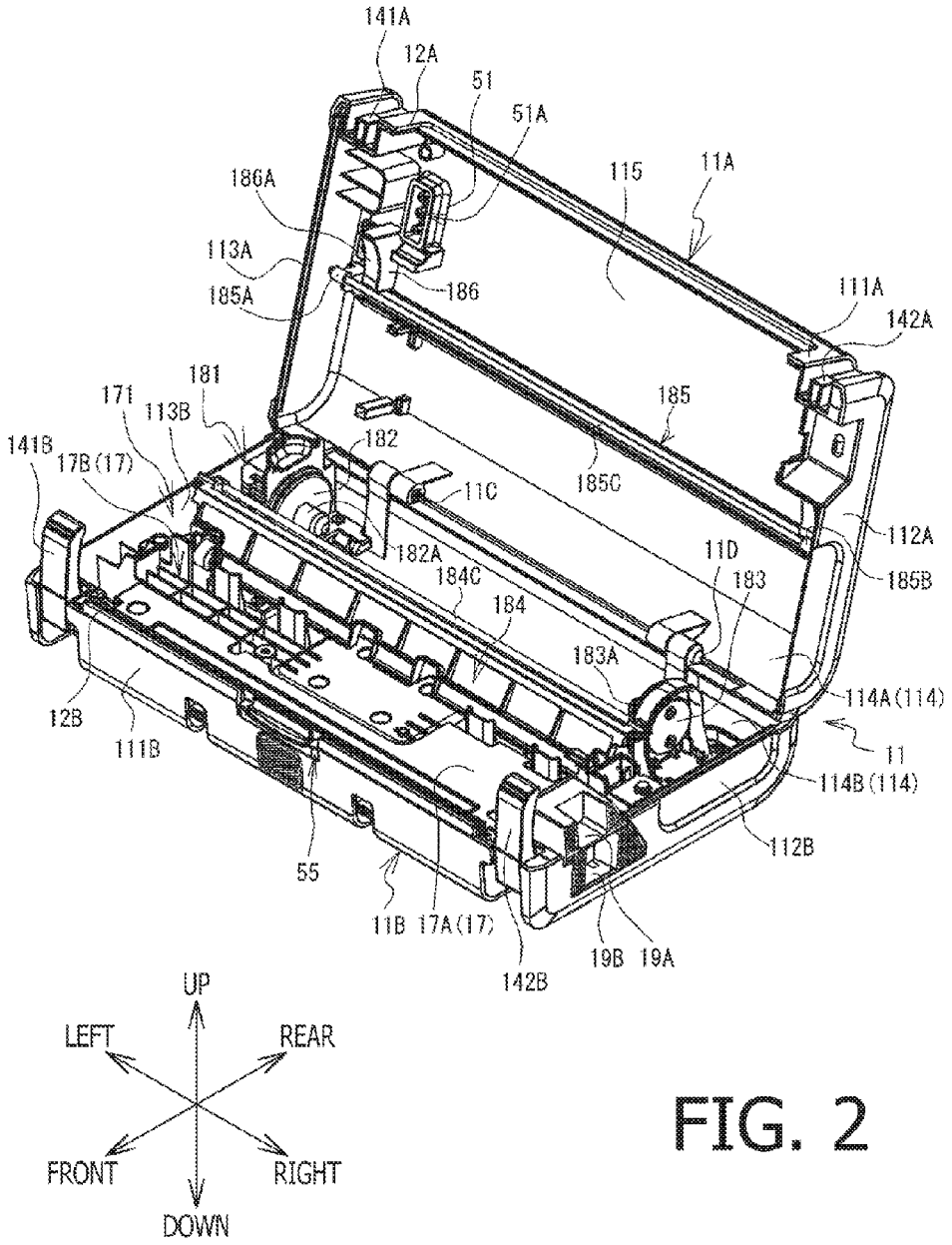
FIG. 2 is a perspective view of the box in an opened state in accordance with the illustrative embodiment.
Figure 3:
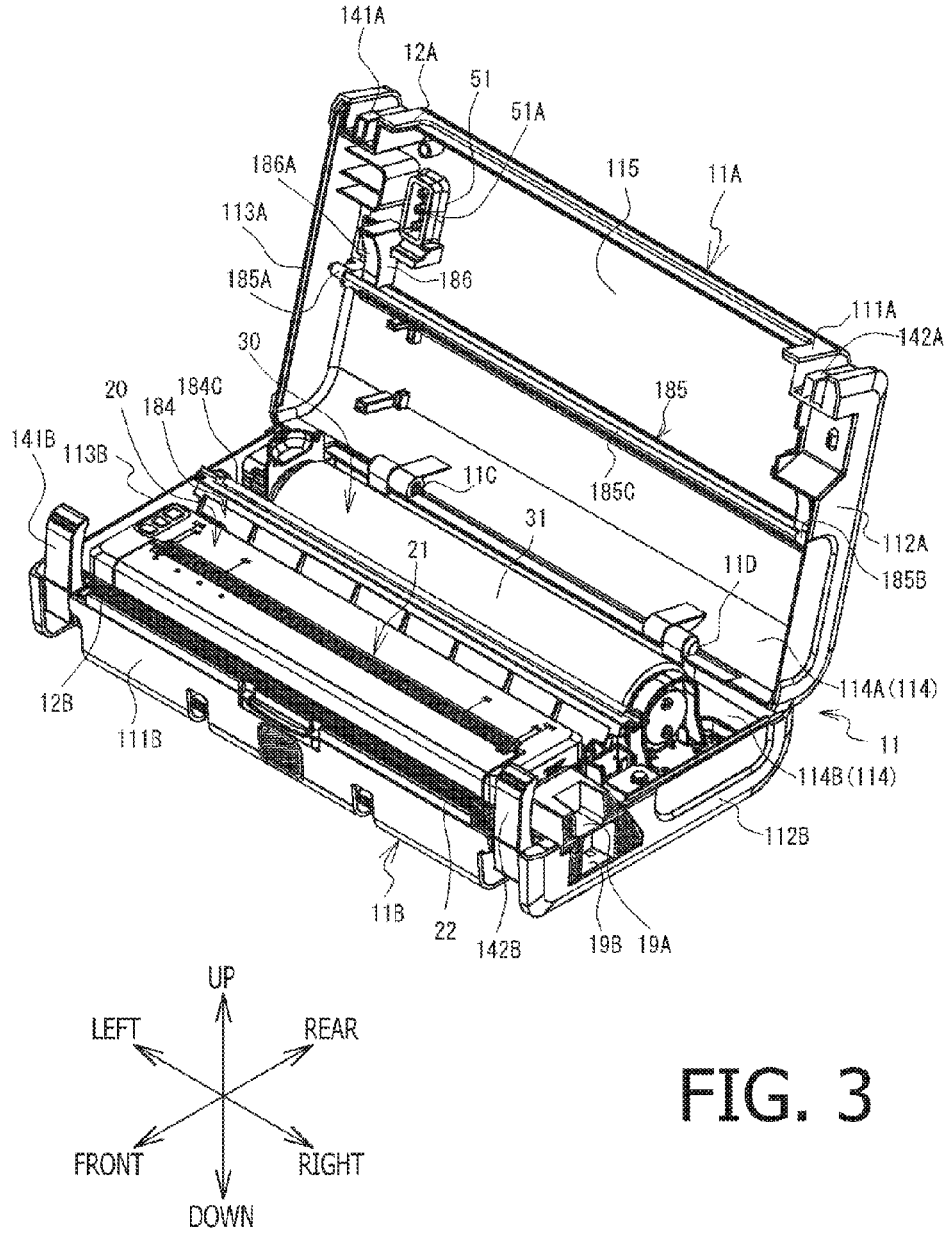
FIG. 3 is a perspective view illustrating the box in the opened state, a printer and a roll in accordance with the illustrative embodiment.

As shown in FIGS. 2 and 3, the upper box 11A and the lower box 11B are connected to each other to be rotatable about shafts 11C and 11D at the rear outer walls 114A and 114B. The box 11 changes between a state where the front outer walls 111A and 111B are close to each other (see FIGS. 1 and 4) and a state where the front outer walls 111A and 111B are separated from each other (see FIGS. 2 and 3). The state shown in FIGS. 1 and 4 where the front outer walls 111A and 111B are close to each other is expressed as a "state where the box 11 is closed". The state shown in FIGS. 2 and 3 where the front outer walls 111A and 111B are separated from each other is expressed as "a state where the box 11 is opened". It should be noted that, in the following, explanation is given in regard to the state where the box 11 is closed unless otherwise specified.

At a left end portion of the front outer wall 111B of the lower box 11B, an extended part 141B is provided. At a right end portion of the front outer wall 111B of the lower box 11B, an extended part 142B is provided. As shown in FIGS. 2 and 3, at a left end portion of the front outer wall 111A of the upper box 11A, a projected part 141A is provided. At a right end portion of the front outer wall 111A of the upper box 11A, a projected part 142A is provided. Each of the projected parts 141A and 142A is formed to project in a direction perpendicularly intersecting with the front outer wall 111A. In the state where the box 11 is closed, the projected part 141A engages with the extended part 141B, and the projected part 142A engages with the extended part 142B. The projected parts 141A and 142A and the extended parts 141B and 142B hold the box in the closed state, and prevent the box 11 from being brought to the opened state.

On a front side in the left end portion of the upper outer wall 115, a key sheet 51 is provided. The key sheet 51 is an elastic push button made of rubber. A pusher 51A projects to a lower side from the lower end of the key sheet 51. When the key sheet 51 is pushed from the upper side, the pusher 51A moves downward, and contacts a contact sensor (see FIG. 6) of the printer 20 which is described later.

On the right outer wall 112B of the lower box 11B, connector connection parts 19A and 19B are provided. Each of the connector connection parts 19A and 19B is formed to be recessed inward. The connector connection parts 19A and 19B are arranged in the up and down direction. In left side walls of the respective connector connection parts 19A and 19B, through holes (not shown) are provided. A user is able to connect a power supply connector to the printer 20 (see FIG. 3) accommodated in the box 11 by inserting, from the outside, the power supply connector into the though hole of the connector connection part 19B. Furthermore, the user is able to connect a USB connector to the printer 20 by inserting, from the outside, the USB connector into the through hole of the connector connection part 19B.

As shown in FIGS. 1 to 3, at the front outer wall 111A of the upper box 11A, a recessed part 12A is provided. The recessed part 12A is provided at a lower edge portion of the front outer wall 111A in the state where the box 11 is closed (see FIG. 1). The recessed part 12A is recessed upward. At the front outer wall 111B of the lower box 11B, a projected part 12B is provided. The projected part 12B is disposed at the upper edge portion of the front outer wall 111B in the state where the box 11 is closed (see FIG. 1). The projected part 12B projects upward. As shown in FIG. 1, in the state where the box 11 is closed, the projected part 12B fits into the recessed part 12A. A gap formed, in the state where the box 11 is closed, between the recessed part 12A and the projected part 12B forms a paper discharge opening 12 in the front outer wall 111 of the box 11.

A lid 50 is provided in the inside of the box 11. The lid 50 is able to move in substantially the up and down direction along an inner surface of the front outer wall 111B of the lower box 11B. In the state where the lid 50 has been moved to the upper side, the lid 50 is able to close the paper discharge opening 12. In the state where the lid 50 has been moved to the lower side, the lid 50 is able to open the paper discharge opening 12. A handle 55 is provided in a central portion of the lid 50 in the left and right direction. The handle 5 is operated by the user to move the lid 50 in substantially the up and down direction between the closed position and the opened position.

<Device Housing Part 171, Roll Housing Part 181>

Figure 4:
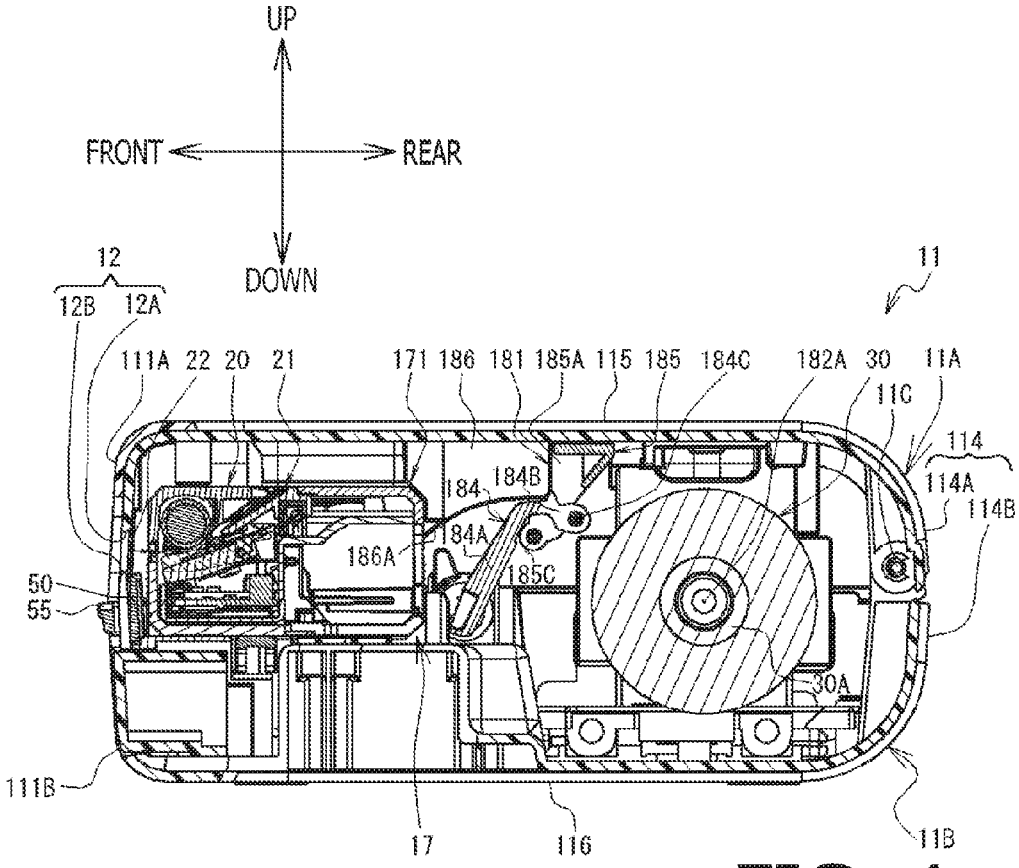
FIG. 4 is a cross sectional view viewed along an arrow direction of an I-I line in FIG. 1.

As shown in FIGS. 2 and 4, in a front portion of the inner space of the box 11, a mounting base 17 is provided. The mounting base 17 includes a plate-like member 17A and a projecting member 17B. The plate-like member 17A is provided to be separated from the lower outer wall 116. The plate-like member 17A extends horizontally. The projecting member 17B projects upward from the lower outer wall 116. The plate-like member 17A and the projecting member 17B form a mounting surface expanding along upper edge parts of the plate-like member 17A and the projecting member 17B. In the following, a space on the upper side of the mounting base 17 in the inner space of the box 11 is referred to as a "device housing box 171".

As shown in FIGS. 3 and 4, the printer 20 is housed in the device housing part 171. The printer 20 is able to perform printing in a thermal ink-transfer printing manner on a print medium 31 which is described later. The printer 20 is formed in a long box shape elongated in the left and right direction. The printer 20 is placed on the upper side of the mounting base 17. The printer 20 has a paper supply part 21 and a paper discharge part 22. The paper supply part 21 is provided on the upper surface of the printer 20. The paper supply part 21 is formed as a slit-like opening for taking the print medium 31 into the inside of the printer 20. The paper supply part 21 extends in the left and right direction. The paper discharge part 22 is provided on the front surface of the printer 20. The paper discharge part 22 is formed as a slit-like opening through which the printed print medium 31 is discharged to the outside. The paper discharge part 22 extends in the left and right direction. As shown in FIG. 4, the paper discharge part 22 is disposed on the rear side of the paper discharge opening 12 of the box 11. The printed print medium 31 being discharged from the paper discharge part 22 is discharged to the outside of the box 11 through the paper discharge opening 12.

On a rear side of the device housing part 171 in the inner space of the box 11, a roll housing part 181 is formed. In the roll housing part 181, roll holding parts 182 and 183, and guide members 184 and 185 are provided. The roll holding part 182 is disposed on the right side of the left outer wall 113B of the lower box 11B. The roll holding part 182 has a projecting part 182A having a cylindrical shape formed to project rightward. The roll holding part 183 is disposed on the left side of the right outer wall 112B of the lower box 11B. The roll holding part 183 has a projecting part 183A having a cylindrical shape formed to project leftward. The roll holding parts 182 and 183 sandwich a roll 30 (see FIG. 3), around which the print medium 31 is wound, from the both sides in the left and right direction. The projecting parts 182A and 183A enter insides of the left and right ends of a core 30A (see FIG. 4) of the roll 30 in the left and right direction. The projecting parts 182A and 183A rotatably hold the roll 30. The roll 30 is housed in the roll housing part 181 in a state where the rotating direction defined when the print medium 31 is sent out becomes the clockwise direction when viewed as a right side view.

<Guide Members 184 and 185>

As shown in FIGS. 2 and 3, the guide member 184 is disposed on the front side of the roll housing part 181. As shown in FIG. 4, the guide member 184 has extended members 184A and 184B, a rod member 184C and a spring (not shown). The extended member 184A is a plate-like member having a rectangular shape elongated in the left and right direction. The extended member 184A is formed to extend to the upper rear side from a position on the rear side with respect to the device housing part 171 and on the upper side with respect to the mounting base 172 in the lower box 11B. The extended member 184A is supported in the lower box 11B to be rotatable about an axis extending in the left and right direction. The extended member 184A is pressed in the counterclockwise direction by a spring (not shown) when viewed as a right side view.

The extended members 184B are formed to extend to the upper rear side from the both ends of the rear edge part of the extended member 184A in the left and right direction. The extended member 184B supports the rod member 184C at the edge part of the extended member 184B. The rod member 184C is a rod-like member having a circular cross section. The rod member 184C is formed to extend in the left and right direction. The both ends of the rod member 184C in the left and right direction are supported by the extended members 184B. The rod member 184C is disposed on the upper side in the up and down direction and on the front side in the front and rear direction with respect to the projecting parts 182A and 183A of the roll holding parts 182 and 183.

As shown in FIGS. 2 and 3, the guide member 185 is provided on the upper outer wall 115 of the box 11. The guide member 185 has extended members 185A and 185B, and a rod member 185C. The extended member 185A is formed to extend inward in the box 11 from a portion near the left edge of the upper outer wall 115. The extended part 185B is formed to extend inward in the box 11 from a portion near the right edge of the upper outer wall 115. As shown in FIG. 4, in the state where the box 11 is closed, the extended members 185A and 185B extend, from a portion of the upper outer wall 115, on the front side with respect to the roll holding parts 182 and 183 and on the rear side with respect to a position where the extended member 184A of the guide member 184 is connected to the lower box 11B. The lower edges of the extended members 185A and 185B support the rod member 185C from the both ends of the rod member 185C in the left and right direction. The rod member 185C is a rod-like member having a circular cross section. The rod member 185C extends in the left and right direction. As shown in FIGS. 2 and 3, in the state where the box 11 is opened, the rod member 184C of the guide member 184 and the rod member 185C of the guide member 185 are separated from each other.

A guide member 186 is provided on the upper outer wall 115 of the box 11. The guide member 186 is provided in a left portion of the upper outer wall 115 and on the front side with respect to the guide member 185. The guide member 186 is a plate-like member. Each surface of the guide member 186 faces to the left or the right. A lower edge 186A of the guide member 186 is formed to bend in an arc shape.

During a process where the box 11 moves from the opened state to the closed state, the edge 186A of the guide part 186 contacts the upper edge of the extended member 184A of the guide member 184. The guide member 186 moves the upper edge of the extended member 184A to the lower rear side along the edge 186A. The guide member 184 rotates in the clockwise direction about a part at which the guide member 184 is connected to the lower box 11B when viewed as a right side view. As shown in FIG. 4, in the state where the box 11 is closed, the rod member 184C of the guide member 184 are disposed to be close to the rod member 185C of the guide member 185. The rod member 185C is disposed on the lower front side with respect to the rod member 184C.

Let us consider, as an example, a case where the roll 30 is set to the roll holding parts 182 and 183 by the user in the state where the box 11 is opened. In this case, the print medium 31 sent out from the lower side of the roll 30 by the user is handled to pass through the rear side and the upper side of the rod member 184C of the guide member 184. The leading edge of the print medium 31 is inserted into the paper supply part 21 of the printer 20.

Then, the box 11 is closed in this state. The rod member 185C of the guide member 185 approaches the rod member 184C from the upper rear side. The guide member 184 rotates in the clockwise direction when viewed as a right side view while contacting the edge 186A of the guide member 186. The rod member 184C moves to the rear side while passing through the upper side of the rod member 185C. The print medium 31 moves to the rear side in accordance with movement of the rod member 184C, and contacts the rod member 185C at a portion on the lower side with respect to a contacting part where the print medium 31 contacts the rod member 184C. The print medium 31 is curved toward the front side at a contacting part with the rod member 185C.

In the state where the box 11 is closed, the print medium 31 extends to the front side of the rod member 185C from the lower side of the roll 30, is curved toward the rear side while contacting the rod member 185C, extends to the rear side while passing thorough the upper side of the rod member 185C and the lower side of the rod member 184C, is curved toward the front side while contacting the rod member 184C, extends to the front side while passing through the upper side of the rod member 184C, and reaches the paper supply part 21 of the printer 20.

The print medium 31 immediately after sent out from the roll 30 has curl that the print medium 31 is curled in the winding direction. On the other hand, the guide members 184 and 185 cause the print medium 31 to be curved in the reverse direction of the curving direction of the curl of the print medium 31. Specifically, the guide members 184 and 185 change the direction pointing to the leading edge of the print medium 31 sent out from the roll 30 from the rear side to the front side at a portion at which the print medium 31 contacts the rod member 184C. The curving direction of the print medium 31 at the portion where the print medium 31 is curved by contacting the rod member 184C is the reverse direction of the curving direction of the curl. Furthermore, the curvature of the print medium 31 at the curving part contacting with the rod member 184C is greater than the curvature of the print medium 31 in the state of being wound around the roll 30. Therefore, the curl of the print medium 31 is restored to the original state by contacting with and being curved by the rod member 184C.

In the following, as shown in FIG. 5, a track along which the print medium 31 sent out from the roll 30 is conveyed to reach the paper discharge opening 12 of the box 11 via the guide members 184 and 185, and the paper supply part 21 and the paper discharge part 22 of the printer 20 is referred to as a "conveying path". A moving direction defined when the print medium 31 moves along the conveying path is referred to as a "conveying direction". The length of a part of the conveying path between the rod member 184C of the guide member 184 and the paper discharge opening 12 is referred to as a "first length L1". The length of a part of the conveying path between the rod member 185C of the guide member 185 and the rod member 184C of the guide member 184 is referred to as a "second length L2". The length of a part of the conveying path between the rod member 185C of the guide member 185 and a thermal head 10 of the printer 10 described later is referred to as a "third length L3". The first length L1, the second length L2 and the third length L3 satisfy a relationship of L1>L3>L2.

<Electric Configuration of Printer 20>

An electric configuration of the printer 20 is explained below with reference to FIG. 6. The printer 20 has a CPU 401 which totally controls of the printer 20. The CPU 401 is electrically connected to a ROM 402, an EEPROM 403, a RAM 404, a flash memory 405, a real time clock (hereafter, referred to as an "RTC") 406, a contact sensor 4, an optical sensor 5, a thermal sensor 6, drive circuits 407 and 408, an external interface 410 and a bus 414. To these components other than the RTC 406, power is supplied thereto when a power supply connector is connected to the connector connection part 19A (see FIG. 1) via the through hole.

The ROM 402 stores a print process (see FIGS. 7 and 8) which the CPU 401 is able to execute, and a program of a standby process (see FIG. 12). The CPU 401 executes various processes based on the program stored in the ROM 402. In the EEPROM 403, characters, symbols and numbers and dot pattern data for printing a barcode and the like are stored while being classified by the format or the size. The RAM 404 stores print data, tentative data, and variables. The flash memory 405 stores a reception time at which print data is received from an external device 7 which is described later. The CPU 401 drives the drive circuits 407 and 408 described later based on print data. With this configuration, the printer 20 is able to perform the printing on the print medium 31 sent out from the roll 30. Furthermore, the flash memory 405 stores a reference table 405A (see FIG. 11) described later, a finish time, and a finish temperature.

The RTC 406 is a clock device known in the art. The RTC 406 is driven by an individual power source. The CPU 401 is able to obtain a present time from the RTC 406. The contact sensor 4 is able to detect an operation to the key sheet 51 (see FIG. 1) of the box 11. The contact sensor 4 contacts the pusher 51A (see FIGS. 2 and 3) when the key sheet 51 is pushed. The contact sensor 4 switches an electric state (conductive/nonconductive) in accordance with the contacting state of the pusher 51A. The optical sensor 5 is able to optically detect presence/absence of the print medium 31. The optical sensor 5 is provided at a position close to the paper supply part 21 (see FIG. 5). The optical sensor 5 has a light emitting part and a light receiving part. The light emitting part of the optical sensor 5 emits light toward the conveying path of the print medium 31 near the paper supply part 21. When the print medium 31 is inserted into the paper supply part 21, the light emitted from the light emitting part is reflected from the print medium 31. The light receiving part of the optical sensor 5 is able to detect the light reflected from the print medium 31. The thermal sensor 6 is a thermistor capable of detecting the temperature of the conveying path of the print medium 31.

The drive circuit 407 supplies power to a heating element of the thermal head 10. The thermal head 10 performs printing in the thermal ink-transfer manner. The thermal head 10 is provided on the downstream side with respect to the optical sensor 5 in the conveying direction (see FIG. 5). The drive circuit 408 rotates a motor 231. The motor 231 is connected to a platen roller 23. The platen roller 23 faces the thermal head 10 (see FIG. 5). In accordance with rotation of the motor 231, the platen roller 23 rotates while pressing the print medium 31 against the thermal head 10. As shown in FIG. 5, in accordance with rotation of the platen roller 23, the print medium 31 is sent out from the roll 30. The print medium 31 sent out from the roll 30 passes by the rod member 185C of the guide member 185 and the rod member 184C of the guide member 184 in this order, and subsequently enters the inside of the printer 20 through the paper supply part 21. The print medium 31 is then conveyed from the paper supply part 21 to the paper discharge part 22 via the thermal head 10 and the platen roller 23.

The external interface 410 receives print data from the external device 7 via a USB connector inserted into the connector connection part 19B (see FIG. 1). The external device 7 is, for example, a PC (Personal Computer).

<Print Process>

Hereafter, a print process is explained with reference to FIG. 7. The CPU 401 starts the print process when the CPU 401 detects, via the external interface 410, receipt of print data transmitted from the external device 7 via the USB connector.

The CPU 401 receives the print data transmitted from the external device 7, and stores the print data in the RAM 404 (step S11). The CPU 401 determines whether the optical sensor 5 is in a state of detecting existence of the print medium 31 (step S13). It is noted that, when the print medium 31 has been inserted into the paper supply part 21 of the printer 20, the optical sensor 5 detects the inserted print medium 31. When the CPU 401 determines that the optical sensor 5 is in the state of detecting existence of the print medium 31 (S13: YES), the CPU 401 advances the process to step S15. The CPU 401 reads out the finish time stored in the flash memory 405 (step S15). As described in detail later, the finish time indicates a time when the printing based on the print data is finished. The finish time is stored in the flash memory 405 through a process of step S45 (see FIG. 8) described later.

The CPU 401 obtains, as a time for starting the printing based on the received print data, the present time from the RTC 406 (step S17). In the following, the time obtained by the process of step S17 is referred to as a "start time". The CPU 401 calculates the elapsed time elapsed from the finish time read out in step S15 to the start time obtained in step S17 (step S19). The CPU 401 obtains the current temperature from the thermal sensor 6 as a temperature when the printing is started (step S21). In the following, the temperature obtained in step S21 is referred to as a "start temperature". The CPU 401 stores the obtained start temperature in the RAM 404 (step S23). The CPU 401 executes a time determination process (see FIG. 10) (step S25).

The time determination process will now be explained with reference to FIG. 10. The CPU 401 reads out the finish temperature stored in the flash memory 405 (step S51). The finish temperature indicates the temperature when the printing is finished. The finish temperature is stored in the flash memory 405 through step S49 (see FIG. 8) described later. The CPU 401 reads out the start temperature stored in step S23 (see FIG. 7) from the RAM 404 (step S53). The CPU 401 determines the first time based on the finish temperature read out in step S51 and the start temperature read out in step S53 by referring to the reference table 405A (see FIG. 11) (step S55). Then, the CPU 401 terminates the time determination process, and returns the process to the print process (See FIG. 7).

The reference table 405A will now be explained with reference to FIG. 11. In the reference table 405A, one of the two first times ("24 hours×7 (7 days)" and "24 hours×3 (3 days)") is associated with the finish temperature and the start temperature each of which is classified into three divisions ("low", "middle", "high").

The CPU 401 executes step S55 (see FIG. 10) as follows. First, the CPU 401 determines which of the three divisions ("low", "middle", "high") each of the start temperature and the finish temperature read out in steps S51 and S53 belongs. Specifically, for example, the CPU 401 determines that the temperature belongs to the division "low" when the temperature is lower than 0 degree, determines that the temperature belongs to the division "middle" when the temperature is higher than or equal to 0 degree and lower than 40 degrees, and determines that the temperature belongs to the division "high" when the temperature is higher than or equal to 40 degrees. Based on the reference table 405A, the CPU 401 determines the first time to which the determined divisions of the respective start temperature and finish temperature belong (step S55).

After the time determination process (S25), the CPU 401 determines whether the elapsed time calculated in step S19 is larger than the first time determined in step S25 as shown in FIG. 7 (step S27). When the CPU 401 determines that the elapsed time is larger than or equal to the first time (S27: YES), the CPU 401 advances the process to step S29. The CPU 401 specifies the length (hereafter, referred to as a "printing length") of a printing area in the conveying direction defined when the printing is performed based on the print data stored in the RAM 404 in step S11 (step S29). The printing area indicates a portion of the print medium 31 within which the printing is performed by heating of the thermal head 10. The CPU 401 determines whether the specified printing length is longer than or equal to the third length (step S31). When the CPU 401 determines that the printing length is smaller than the third length (S31: NO), the CPU 401 advances the process to step S41 (see FIG. 8). When the CPU 401 determines that the printing length is larger than or equal to the third length (S31: YES), the CPU 401 advances the process to step S33.

The CPU 401 rotates the motor 231 by controlling the drive circuit 408. Thus, the CPU 401 causes the platen roller 23 to convey the print medium 31 to the downstream side in the conveying direction by the first length (step S33). After causing the platen roller 23 to convey the print medium 31 to the downstream side by the first length, the CPU 401 controls the drive circuit 408 to stop rotation of the motor 31. As a result, the CPU 401 stops conveying of the print medium 31 to the downstream side (step S35). Then, the CPU 401 advances the process to step S41 (see FIG. 8).

As shown in FIG. 8, the CPU 401 determines whether an operation of pushing the key sheet 51 for starting the printing is conducted based on an electric status of the contact sensor 4 (step S41). When the CPU 401 determines that the operation of pushing the key sheet 51 is not conducted (S41: NO), the CPU 401 returns the process to step S41. When the CPU 401 determines that the operation of pushing the key sheet 51 is conducted (S41: YES), the CPU 401 advances the process to step S43.

The CPU 401 rotates the motor 231 by controlling the drive circuit 408. Thus, the CPU 401 causes the platen roller 23 to convey the print medium 31 to the downstream side. Concurrently, the CPU 401 controls the drive circuit 407 based on the print data stored in the RAM 404 to cause the thermal head 10 to generate heat. As a result, the printing is performed for the print medium 31 based on the print data (step S43).

As a time when the printing based on the print data is finished, the CPU 401 obtains the present time from the RTC 406. The obtained time corresponds to the finish time. The CPU 401 stores the obtained finish time in the flash memory 405 (step S45). As a temperature when the printing is finished, the CPU 401 obtains the present temperature from the thermal sensor 6 (step S47). In the following, the temperature obtained in step S47 is referred to as "finish temperature". The CPU 401 stores the obtained finish temperature in the flash memory 405 (step S49). Then, the CPU 401 terminates the print process.

As shown in FIG. 7, when the CPU 401 determines that the elapsed time is smaller than the first time (S27: NO), the CPU 401 advances the process to step S71 (see FIG. 9). As shown in FIG. 9, the CPU 401 controls the drive circuit 408 to rotate the motor 231. Thus, the CPU 401 causes the platen roller 23 to convey the print medium 31 to the downstream side. Concurrently, the CPU 401 controls the drive circuit 407 based on the print data stored in the RAM 404 to cause the thermal head 10 to generate heat. As a result, the printing for the print medium 31 is started (step S71).

The CPU 401 determines whether the print medium 31 has been conveyed by the third length L3 since the start of the printing (step S73). When the CPU 401 determines that the print medium 31 has not been conveyed by the third length L3 (S73: NO), the CPU 401 controls the drive circuit 408 to rotate the motor 231 so that the platen roller 23 rotates at a second rotation speed. Thus, the print medium 31 is conveyed at a second conveying speed (step S77). Then, the CPU 401 advances the process to step S79. When the CPU 401 determines that the print medium 31 has been conveyed by the third length L3 (S73: YES), the CPU 401 controls the drive circuit 408 to rotate the motor 231 so that the platen roller 23 rotates at a first rotation speed which is slower than the second rotation speed. As a result, the print medium 31 is conveyed at a first conveying speed which is slower than the second conveying speed (step S75). Then, the CPU 401 advances the process to step S79.

The CPU 401 determines whether the printing based on the print data is completed (step S79). When the CPU 401 determines that the printing is not completed (S79: NO), the CPU 401 returns the process to step S73. When the CPU 401 determines that the printing is completed (S79: YES), the CPU 401 advances the process to step S45 (see FIG. 8). Explanations about steps S45, S47 and S49 (see FIG. 8) are omitted.

As shown in FIG. 7, when it is determined in step S13 that the optical sensor 5 is not in the state of detecting existence of the print medium 31 (S13: NO), the CPU 401 advances the process to step S37. The CPU 401 determines whether the state is changed from the state where the optical sensor 5 is not detecting existence of the print medium 31 to the state where the optical sensor 5 is detecting existence of the print medium 31 (step S37). When the CPU 401 determines that the state is changed from the state where the optical sensor 5 is not detecting existence of the print medium 31 to the state where optical sensor 5 is detecting existence of the print medium 31 (S37: YES), the CPU 401 advances the process to step S71 (see FIG. 8).

When the CPU 401 determines that the state is not changed from the state where optical sensor 5 is not detecting existence of the print medium 31 to the state where optical sensor 5 is detecting existence of the print medium 31 (S37: NO), the CPU 401 advances the process to step S39. The CPU 401 determines whether an operation of pushing the key sheet 51 of the box 11 in order to terminate the printing is conducted based on the electric state of the contact sensor 4 (step S39). When the CPU 401 determines that an operation of pushing the key sheet 51 of the box 11 in order to terminate the printing is not conducted (S39: NO), the CPU 401 returns the process to step S37. When is the CPU 401 determines that an operation of pushing the key sheet 51 of the box 11 in order to terminate the printing is conducted (S39: YES), the CPU 401 terminates the print process.

<Standby Process>

The standby process will now be explained with reference to FIG. 12. When the print process (FIG. 7) is not executed in the state where power is supplied to the printer 20 via the power supply connector, the CPU 401 executes the standby process. The CPU 401 determines whether the second time has elapsed from last execution of step S63 which is described later (step S61). The second time is set to be shorter than each of the first times defined in the reference table 405A. When the CPU 401 determines that the second time has not elapsed (S61: NO), the CPU 401 returns the process to step S61. When the CPU 401 determines that the second time has elapsed (S61: YES), the CPU 401 advances the process to step S63. That is, step S63 is executed periodically at intervals of the second time.

The CPU 401 controls the drive circuit 408 to rotate the motor 231. Thus, the CPU 401 causes the platen roller 23 to convey the print medium 31 to the downstream side by the second length (step S63). After the platen roller 23 has conveyed the print medium 31 to the downstream side by the second length, the CPU 401 controls the drive circuit 408 to stop rotation of the motor 231. As a result, the CPU 401 stops conveying of the print medium 31 to the downstream side (step S65). Then, the CPU 401 returns the process to step S61.

<Advantageous Effects>

As shown in FIG. 5, the box 11 has the function of correcting curl in the winding direction (the clockwise direction when viewed in the left side view) of the print medium 31 sent out from the roll 30 with the guide members 184 and 185. The rod member 184C of the guide member 184 corrects the curl in the winding direction by curving the print medium 31 in the counter clockwise direction (hereafter, referred to as a "reverse direction") when viewed as the right side view. The printer 20 executes the printing on the print medium 31 of which curl has been corrected by the guide members 184 and 185.

As the time elapses in the state where the print medium 31 is not conveyed, the print medium 31 becomes easier to have curling tendency of curling in the reverse direction by the rod member 184C of the guide member 184. By contrast, when the elapsed time from the finish time to the start time is longer than the first time (S27: YES), the CPU 401 of the printer 20 conveys the print medium 31 by the first length L1 (step S33), and thereafter performs printing on the print medium 31 (step 43). The first length L1 corresponds to the length from the rod member 184C of the guide member 184 to the paper discharge opening 12.

In the above described configuration, the first length L1 is longer than the length (the third length L3) of the conveying path from the rod member 184C to the thermal head 10 in the conveying direction. Therefore, as shown in FIG. 13, the above described printing is started from the upstream side of the part 31A of the print medium 31 at which the curl bending in the reverse direction is caused. Therefore, in the printing area of the print medium 31 within which the printing is performed, the part 31A at which the curl in the reverse direction is caused in not included. As a result, it becomes possible to appropriately perform the printing on a part of the print medium 31 not including the part 31A at which the curl is caused.

After the CPU 401 conveys the print medium 31 by the first length L1 before the printing, the CPU 401 stops conveying (step S35). In this state, the part 31A of the print medium 31 at which the curl in the reverse direction is caused is discharged from the paper discharge opening 12 (see FIG. 13). When the operation of pushing the key sheet 31 is conducted (S41: YES), the CPU 401 starts the printing (step S43). Therefore, for example, the user is able to cut out, from the roll 30 side, the part 31A of the print medium 31 at which the curl in the reverse direction is caused before the printing in the state where the conveying of the print medium 31 is stopped tentatively. Thereafter, by pushing the key sheet 51, the user is able to start the printing in the state where the part 31A at which the curl in the reverse direction is caused is cut out.

The curling tendency of the print medium 31 in the reverse direction changes depending on the temperature. Typically, as the temperature becomes higher, the curling in the reverse direction becomes easier to be caused. By contrast, the CPU 401 determines the first time in accordance with the obtained temperature (step S25). When the elapsed time from the finish time to the start time is longer than the first time (S27: YES), the CPU 401 conveys the print medium 31 by the first length L1 (step S33), and thereafter executes the printing on the print medium 31 (step S43). Therefore, by changing the first time depending on the temperature, the CPU 401 is able to appropriately determine whether the curl in the reverse direction is caused by the guide member 184 and thereby appropriately determine whether to convey the print medium 31 by the first length L1. Accordingly, it becomes possible to reduce the possibility that the print medium 31 is conveyed by the first length L1 regardless of the fact that no curl is caused in the reverse direction. As a result, it becomes possible to effectively use the print medium 31.

The CPU 401 determines the first time based on the start temperature and the finish temperature while referring to the reference table 405A (step S55). In this case, the CPU 401 is able to more appropriately determine whether the curl in the reverse direction is caused by the guide member 184 based on the start temperature and the finish temperature, and is able to determine whether to convey the print medium 31 by the first length L1.

As shown in FIG. 14, the CPU 401 conveys the print medium 31 to the downstream side by the length L2 at the intervals of the second time which is shorter than the first time (step S63). As a result, the CPU 401 is able to decrease the time within which a particular part of the print medium 31 contacts the rod member 184C of the guide member 184. Therefore, the CPU 401 is able to prevent the curl in the reverse direction from being caused on the print medium 31 by the guide member 184.

As an example, let us consider a case where the length of the printing area in the conveying direction is shorter than the third length L3. In this case, when the printing is executed without performing conveying before printing, the printing on the print medium 31 is finished at a position on the downstream side in the conveying direction with respect to the part 31A at which the curl in the reverse direction is caused. Therefore, it is not necessary to convey the print medium 31 by the first length L1. By contrast, only when the length of the printing area in the conveying direction is longer than the third length L3 (S31: YES), the CPU 401 conveys the print medium 31 by the first length L1 before printing (step S33). As a result, the CPU 401 is able to effectively use the print medium 31.

When the CPU 401 determines that the elapsed time is shorter than the first time (S27: NO), the CPU 401 does not convey the print medium 31 by the first length L1 before the printing. Instead, when the print medium 31 has been conveyed by the third length L3 from the start of printing, the CPU 401 sets the conveying speed of the print medium 31 to the relatively slow first conveying speed. A part of the print medium 31 which has contacted the rod member 184C of the guide member 184 before the start of printing is sandwiched by the thermal head 10 and the platen roller 23 in a state where the print medium 31 has been conveyed by the third length L3 from the start of printing. In this case, when the conveying speed of the print medium 31 is relatively slow, the time within which the print medium 31 is pressed against the thermal head 10 by the platen roller 23 becomes relatively long. The curl caused in the reverse direction on the print medium 31 by the rod member 184C of the guide member 184 becomes easier to be removed by being pressed against the thermal head 10 by the platen roller 23. Therefore, the curl caused on the print medium 31 by the rod member 184C can be removed by the platen roller 23 during the printing.

<Variations>

It is understood that aspects of the present disclosure are not limited to the above described illustrative embodiment, but can be varied in various ways. In the above described illustrative embodiment, the printing manner of the printer 20 is not limited to the ink-transfer printing manner. For example, inkjet printing or laser printing may be used. In the above described illustrative embodiment, the printer 20 is used in the state where the printer 20 is attached to the box 11. The roll 30 around which the print medium 31 is wound is attached to the box 11. The mechanism (the guide members 184 and 185) which removes the curl of the print medium 31 is provided on the box 11. By contrast, the printer 20 may be an apparatus used as a standalone apparatus. In such a case, the printer 20 may include the roll 30 and the mechanism which removes curl of a print medium.

The first length may be defined as the length obtained by adding a particular length to the length of a part of the conveying path of the print medium 31 from the rod member 184C of the guide member 184 to the thermal head 10 of the printer 20. That is, the first length may be larger than the length in the conveying direction between the rod member 184C of the guide member 184 and the thermal head 10 of the printer 20.

The CPU 401 stops tentatively the conveying after the print medium 31 has been conveyed by the first length (step S35). When the CPU 401 determines that the operation of pushing the key sheet 51 is conducted in this state (S41: YES), the CPU 401 executes the printing on the print medium 31. For example, when the printer 20 is provided with a buzzer or an LCD (Liquid Crystal Display), the CP 401 may inform the user of statuses. The CPU 401 may execute the printing on the print medium 31 after tentatively stopping the conveying of the print medium 31 for a particular time (e.g., 5 seconds).

The CPU 401 determines the first time based on the start time and the finish time by referring to the reference table 405A (step S25). The CPU 401 may obtain the start time and the finish time based on time information contained in the print data by which a time can be specified. In such a case, the printer may not include the RTC 406. The CPU 401 may calculate the first time by substituting the start time and the finish time into a particular equation. The CPU 401 may obtain, as the start time, the reception time stored in the flash memory. The CPU 401 may periodically obtain the temperature during the time elapsed from the end of the last printing to the start of new printing. The CPU 401 may determine the first time based on a plurality of obtained temperatures. The CPU 401 may determine the first time based only on the start time or may determine the first time based only on the finish time. The printer 20 may include a sensor which measures humidity. The CPU 401 may determine the first time based on the temperature and humidity. The printer 20 may be able to set the type of the print medium 31. In this case, the CPU 401 may determine the first time based on the set type of the print medium 31. The printer 20 may be configured such that the first time can be designated. In this case, the CPU 401 may execute the process based on the designated first time.

In the standby state, the CPU 401 periodically conveys the print medium 31 to the downstream side in the conveying direction by the second length. By contrast, the CPU 401 may execute alternately the process in which the print medium 31 is conveyed to the downstream side by the second length and the process in which the print medium 31 is conveyed to the upstream side by the second length.

What is claimed is:

1. A printer, comprising:

a printing part configured to perform printing on a print medium;

a conveying mechanism configured to send out the print medium from a medium roll around which the print medium is wound and to convey the print medium via the printing part, the conveying mechanism comprising a correcting mechanism configured to correct curl of the print medium caused in a winding direction of the print medium by curving the print medium in a reverse direction of the winding direction; and a controller configured to:

store a finish time of the printing by the printing part in a storage device;

obtain a start time when next printing is started by the printing part after previous printing has been finished;

determine whether an elapsed time elapsed from the finish time stored in the storage device to the obtained start time is longer than a particular time;

when the controller determines that the elapsed time is longer than the particular time, cause the conveying mechanism to convey the print medium by a particular length which is longer than a length, in a conveying direction along a conveying path of the print medium, between the correcting mechanism and the printing part; and cause the printing part to perform the printing on the print medium after the print medium has been conveyed by the particular length.

2. The printer according to claim 1, wherein the controller is further configured to:

stop conveying of the print medium after the print medium has been conveyed by the particular length; and accept an operation, and wherein the controller causes the printing part to perform the printing on the print medium when the operation is accepted.

3. The printer according to claim 1, wherein the controller is further configured to:

obtain temperature; and determine the particular time based on the obtained temperature, and wherein the controller determines whether the elapsed time is longer than the determined particular time.

4. The printer according to claim 3, wherein:

the temperature obtained by the controller comprises a finish temperature obtained when the finish time is stored in the storage device and a start temperature obtained when the start time is obtained; and the controller determines the particular time based on the finish temperature and the start temperature.

5. The printer according to claim 1, wherein the controller is further configured to cause the conveying mechanism to periodically convey the print medium by an auxiliary particular length shorter than the particular length.

6. The printer according to claim 1, wherein the controller is further configured to:

obtain print data; and determine whether a length of a printing area within which the printing is performed by the printing part based on the obtained print data is longer than or equal to a supplementary particular length, the supplementary particular length being a length defined in the conveying direction between the correcting mechanism and the printing part, and wherein when the controller determines that the length of the printing area in the conveying direction is longer than or equal to the supplementary particular length, the controller causes the conveying mechanism to covey the print medium by the particular length.

* * * * *